US010859017B2

(12) United States Patent
Eckart et al.

(10) Patent No.: US 10,859,017 B2
(45) Date of Patent: Dec. 8, 2020

(54) METHOD FOR CONTROLLING AN EXHAUST GAS COMPONENT FILLING LEVEL IN AN ACCUMULATOR OF A CATALYTIC CONVERTER

(71) Applicant: Robert Bosch GmbH, Stuttgart (DE)

(72) Inventors: Matthias Eckart, Bietigheim-Bissingen (DE); Alexandre Wagner, Stuttgart (DE); Jens Oehlerking, Stuttgart (DE); Joerg Frauhammer, Gemmrigheim (DE); Martin Knopp, Markgroeningen (DE); Michael Fey, Wiernsheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/461,032

(22) PCT Filed: Oct. 26, 2017

(86) PCT No.: PCT/EP2017/077486
§ 371 (c)(1),
(2) Date: May 15, 2019

(87) PCT Pub. No.: WO2018/091252
PCT Pub. Date: May 24, 2018

(65) Prior Publication Data

US 2019/0309698 A1 Oct. 10, 2019

(30) Foreign Application Priority Data

Nov. 15, 2016 (DE) ..... 10 2016 222 418

(51) Int. Cl.
*F02D 41/02* (2006.01)
*F02D 41/14* (2006.01)
*F01N 11/00* (2006.01)

(52) U.S. Cl.
CPC ..... *F02D 41/0295* (2013.01); *F02D 41/1439* (2013.01); *F02D 41/1441* (2013.01);
(Continued)

(58) Field of Classification Search
CPC ..... F02D 41/0295; F02D 41/1439; F02D 41/1441; F02D 41/1456; F02D 41/1458;
(Continued)

(56) References Cited

U.S. PATENT DOCUMENTS 6,073,440 A * 6/2000 Douta ..... F01N 11/007 60/277
6,823,666 B2 * 11/2004 Odendall ..... F02D 41/029 60/297

(Continued)

FOREIGN PATENT DOCUMENTS

DE 19606652 8/1997
DE 10339063 2/2005

(Continued)

OTHER PUBLICATIONS

International Search Report for Application No. PCT/EP2017/077486 dated Jan. 25, 2018 (English Translation, 3 pages).

*Primary Examiner* — Thai Ba Trieu
(74) *Attorney, Agent, or Firm* — Michael Best & Friedrich LLP

(57) ABSTRACT

A method for controlling a filling level of an exhaust gas component accumulator of a catalytic converter in the exhaust gas of an internal combustion engine where an actual filling level of the accumulator is determined with a first catalytic converter model. The method includes forming a lambda setpoint is formed, wherein a predetermined target fill level is converted into a base lambda setpoint via a second system model reverse of the first catalytic converter model, a deviation of the actual fill level from the predeter- (Continued)

mined target fill level is determined and processed to a lambda setpoint correction value via a fill level control unit, a sum of the base lambda setpoint value and the lambda setpoint value correction value is formed, and said sum is used to form a correction value, with which fuel metering to at least one combustion chamber of the internal combustion engine is influenced.

18 Claims, 3 Drawing Sheets

(52) U.S. Cl.
CPC ..... *F02D 41/1456* (2013.01); *F02D 41/1458* (2013.01); *F01N 11/002* (2013.01); *F01N 2900/1624* (2013.01); *F02D 2041/1419* (2013.01); *F02D 2041/1434* (2013.01); *F02D 2200/0814* (2013.01); *F02D 2200/0816* (2013.01)

(58) Field of Classification Search
CPC ..... F02D 2041/1419; F02D 2041/1434; F02D 2200/0814; F02D 2200/0816; F01N 11/002; F01N 2900/1624
USPC ..... 60/274, 295, 297; 123/443, 672, 123/703–704
See application file for complete search history.

(56) References Cited

U.S. PATENT DOCUMENTS

| | | | | |
|---|---|---|---|---|
| 7,198,952 | B2 * | 4/2007 | Uchida | F02D 41/1408 60/277 |
| 7,343,786 | B2 * | 3/2008 | Pfister | F01N 11/002 73/114.75 |
| 7,677,029 | B2 * | 3/2010 | Matsuno | F02D 41/029 60/295 |
| 7,849,677 | B2 * | 12/2010 | Matsuno | F01N 9/002 60/295 |
| 2009/0151323 | A1 * | 6/2009 | Severin | F01N 11/002 60/295 |
| 2012/0120981 | A1 * | 5/2012 | Genssle | F01N 11/002 374/1 |
| 2020/0123996 | A1 * | 4/2020 | Fey | F02D 41/1441 |

FOREIGN PATENT DOCUMENTS

| | | |
|---|---|---|
| DE | 102005061875 | 7/2007 |
| DE | 102013204422 | 9/2013 |
| DE | 102013017260 | 12/2014 |
| DE | 102015100286 | 7/2015 |
| DE | 102015202354 | 8/2015 |
| DE | 102015107954 | 12/2015 |

* cited by examiner

METHOD FOR CONTROLLING AN EXHAUST GAS COMPONENT FILLING LEVEL IN AN ACCUMULATOR OF A CATALYTIC CONVERTER

BACKGROUND OF THE INVENTION

The present invention concerns a method for controlling a filling level of an exhaust gas component accumulator of a catalytic converter in the exhaust gas of a combustion engine. In the device aspects thereof the present invention concerns a control unit.

Such a method and such a control unit are each known from DE 103 39 063 A1 for oxygen as an exhaust gas component. With the known method and control unit, an actual fill level of oxygen in a catalytic converter volume is calculated from operating parameters of the combustion engine and the exhaust system with a catalytic converter model, and the adjustment of the fuel/air ratio is carried out depending on a difference of the actual fill level from a specified fill level setpoint. Moreover, such a method and such a control unit are also known from DE 196 06 652 A1 by the applicant.

In the event of incomplete combustion of the air-fuel mixture in a gasoline engine, in addition to nitrogen ($N_2$), carbon dioxide ($CO_2$) and water ($H_2O$), a number of combustion products are ejected, of which hydrocarbons (HC), carbon monoxide (CO) and oxides of nitrogen ($NO_x$) are restricted by law. The applicable exhaust limits for motor vehicles can only be satisfied with catalytic exhaust gas aftertreatment according to the current prior art. The mentioned harmful components can be converted by the use of a three-way catalytic converter.

A simultaneous high conversion rate for HC, CO and $NO_x$ is only achieved with three-way catalytic converters in a narrow lambda range about the stoichiometric operating point (lambda=1), the so-called conversion window.

For operating the three-way catalytic converter in the conversion window, a lambda controller is typically used in current engine control systems, being based on the signals of lambda probes disposed before and after the three-way catalytic converter. For the control of the air ratio lambda, which is a measure of the composition of the fuel/air ratio of the combustion engine, which is the oxygen concentration prevailing in the exhaust gas upstream of the three-way catalytic converter, the oxygen content of the exhaust gas upstream of the three-way catalytic converter is measured with a forward exhaust gas probe that is disposed there. Depending on the measurement value, the controller corrects the amount of fuel or injection pulse width specified in the form of a base value of a pilot control function. In the context of the pilot control function, base values of the amounts of fuel to be injected are specified as a function of the revolution rate of and the load on the combustion engine. For more accurate control, in addition the oxygen concentration of the exhaust gas, for example downstream of the three-way catalytic converter, is detected with a further exhaust gas probe. The signal of the rear exhaust gas probe is used for master control, which is superimposed on the lambda control upstream of the three-way catalytic converter based on the signal of the forward exhaust gas probe. As a rule, a step-type lambda probe is used as the exhaust gas probe that is disposed downstream of the three-way catalytic converter, which has a very steep characteristic curve for lambda=1 and therefore lambda=1 can be displayed very accurately (Kraftfahrtechnisches Taschenbuch (Automotive Pocketbook), 23$^{rd}$ Edition, Page 524).

Besides the master control, which in general only corrects small differences from lambda=1 and which is designed to be comparatively slow, as a rule there is a functional unit in current engine control systems that ensures that the conversion window is reached again rapidly following large differences from lambda=1 in the form of a lambda pilot control, which for example is important after phases with overrun shutdown in which the three-way catalytic converter is loaded with oxygen. This affects the $NO_x$ conversion.

Because of the oxygen storage capacity of the three-way catalytic converter, lambda can still=1 for several seconds downstream of the three-way catalytic converter after a rich or lean lambda has been set upstream of the three-way catalytic converter. The property of the three-way catalytic converter, of storing oxygen temporarily, is exploited to compensate short-term differences from lambda=1 upstream of the three-way catalytic converter. If lambda is not equal to 1 for along period upstream of the three-way catalytic converter, the same lambda is also set downstream of the three-way catalytic converter once the oxygen fill level for lambda >1 (excess of oxygen) exceeds the oxygen storage capacity or once no more oxygen is being stored in the three-way catalytic converter for lambda <1. At this point in time a step-type lambda probe downstream of the three-way catalytic converter indicates exiting the conversion window. Up to the point in time however, the signal of the lambda probe that is downstream of the three-way catalytic converter does not indicate the impending breakthrough, and a master control therefore often responds so late based on the signal that the fuel metering can no longer respond in a timely manner before a breakthrough. Consequently, increased tail pipe emissions occur. Current regulation concepts therefore have the disadvantage that they only detect exiting the conversion window late using the voltage of the step-type lambda probe that is downstream of the three-way catalytic converter.

One alternative for controlling the three-way catalytic converter based on the signal of a lambda probe downstream of the three-way catalytic converter is control of the average oxygen fill level of the three-way catalytic converter. Although the average fill level is not measurable, it can be modelled by calculations according to the aforementioned DE 103 39 063 A1.

A three-way catalytic converter is however a complex nonlinear system with time-variable system parameters. Moreover, the measured or modelled input variables for a model of the three-way catalytic converter are usually subject to uncertainties. Therefore, a generally applicable catalytic converter model that can describe the behavior of the three-way catalytic converter sufficiently accurately in different operating states (for example at different engine operating points or for different stages of catalytic converter aging) is not available in an engine control system as a rule.

SUMMARY OF THE INVENTION

In the present invention, a lambda setpoint value is formed, wherein a predetermined fill level setpoint is converted into a base lambda setpoint value by a second catalytic converter model that is the inverse of the first catalytic converter model, wherein a difference of the actual fill level from the specified fill level setpoint is determined and processed into a lambda setpoint value correction value by a fill level control means, a sum of the base lambda setpoint value and the lambda setpoint value is formed and the sum is used to form a correction value, with which fuel metering to at least one combustion chamber of the combustion engine is influenced.

The control of the fill level of the three-way catalytic converter based on the signal of an exhaust gas probe that is disposed upstream of the three-way catalytic converter has the advantage that a previous exit from the catalytic converter window earlier than for a master control, which is based on the signal of an exhaust gas probe that is disposed downstream of the three-way catalytic converter, can be detected, so that the exit from the catalytic converter window can be counteracted by a well-timed correction of the air-fuel mixture. In this connection, the invention enables improved control of an amount of oxygen that is stored in the catalytic converter volume, with which exiting the conversion window is detected and prevented in a timely manner, and which at the same time has a more balanced fill level reserve against dynamic disturbances than existing control concepts. The emissions can be reduced as a result. Stricter legal requirements can be satisfied with lower costs for the three-way catalytic converter.

A preferred design is characterized in that a lambda control is carried out in a first control circuit in which the signal of a first exhaust gas probe that is disposed upstream of the catalytic converter is processed as the actual lambda value and in that the lambda setpoint value is formed in a second control circuit, wherein the predetermined fill level setpoint is converted into a base lambda setpoint value of the lambda control by the second catalytic converter model that is inverse to the first catalytic converter model, wherein parallel thereto a fill level control error is formed as the difference of the fill level modelled with the first catalytic converter model from the filtered fill level setpoint value, the fill level control error is delivered to a fill level control algorithm, which forms a lambda setpoint value correction value therefrom, and wherein the lambda setpoint value correction value is added to the base lambda setpoint value calculated by the inverse second catalytic converter model and the sum calculated thereby forms the lambda setpoint value.

It is also preferable that the first catalytic converter model is a component of a system model comprising an output lambda model in addition to the first catalytic converter model.

A system model is understood here to be an algorithm that combines input variables, which also act on the real object that is simulated with the system model, with output variables such that the calculated output variables correspond very accurately to the output variables of the real object. In the case under consideration, the real object is the entire physical system lying between the input variables and the output variables. The signal of the rear exhaust gas probe is modelled computationally with the output lambda model. Further, it is preferable that the first catalytic converter model comprises an input emission model, a fill level model and an emission model.

A further preferred design is characterized in that the first catalytic converter model comprises sub models, each of which is associated with a sub volume of the real three-way catalytic converter.

It is further preferred that the output lambda model is designed to convert the concentrations of the individual exhaust gas components calculated using the first catalytic converter model into a signal that can be compared with the signal of a further exhaust gas probe that is disposed downstream of the catalytic converter and that is exposed to the exhaust gas.

A further preferred design is characterized in that the signal calculated with the emission model is compared with the signal measured by the further exhaust gas probe.

The comparison enables the compensation of inaccuracies of measurement variables or model variables that enter the system model.

It is also preferable that the predetermined setpoint value lies between 25% and 35% of the maximum oxygen storage capacity of the three-way catalytic converter.

With regard to embodiments of the control unit, it is preferable that it is designed to control execution of the method according to one of the preferred embodiments of the method.

Further advantages result from the description and the accompanying figures.

It will be understood that the aforementioned features and the features that are yet to be described can be used not only in the respectively specified combination, but also in other combinations or on their own without departing from the scope of the present invention.

BRIEF DESCRIPTION OF THE DRAWINGS

Exemplary embodiments of the invention are represented in the drawings and are described in detail in the following description. In this case, the same reference characters in different figures each refer to the same elements or at least to functionally comparable elements. In the figures, in schematic form in each case.

DETAILED DESCRIPTION

The invention is described below using the example of a three-way catalytic converter and for oxygen as the exhaust gas component to be stored. But the invention can also be correspondingly transferred to other types of catalytic converter and exhaust gas components such as oxides of nitrogen and hydrocarbons. An exhaust system with a three-way catalytic converter is assumed below for the sake of simplicity. The invention is correspondingly also transferable to exhaust systems with a plurality of catalytic converters. In this case the front and rear zones described below can extend over a plurality of catalytic converters or can lie in different catalytic converters.

Figure 1:
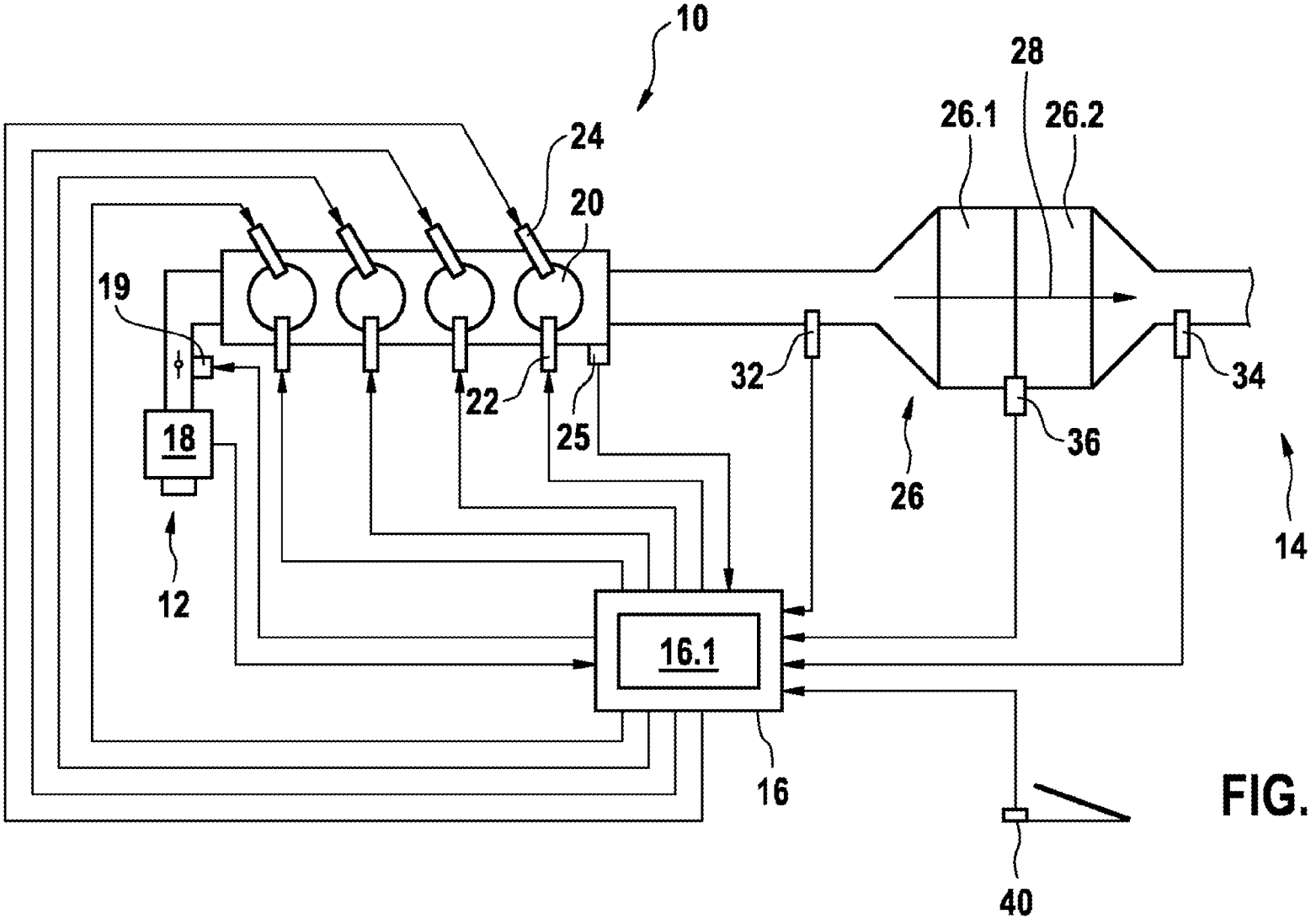
FIG. 1 shows a combustion engine with an exhaust system as the technical environment of the invention.

FIG. 1 shows a combustion engine 10 with an air delivery system 12, an exhaust system 14 and a control unit 16 in detail. In the air delivery system 12 there is an air flow sensor 18 and a choke flap of a choke flap unit 19 disposed downstream of the air flow sensor 18. The air flowing via the air delivery system 12 into the combustion engine 10 is mixed in combustion chambers 20 of the combustion engine 10 with gasoline that is directly injected into the combustion chambers 20 by means of injection valves 22. The resulting combustion chamber fillings are ignited and combusted with ignition devices 24, for example ignition plugs. A rotation angle sensor 25 detects the rotation angle of a shaft of the combustion engine 10 and as a result the control unit 16 enables triggering of the ignitions in specified angular positions of the shaft. The exhaust gas resulting from the combustions is passed through the exhaust system 14.

The exhaust system 14 comprises a catalytic converter 26. The catalytic converter 26 is for example a three-way catalytic converter, which as is well known converts the three exhaust gas components, oxides of nitrogen, hydrocarbons and carbon monoxide, on three reaction pathways and has an oxygen storing effect. In the example represented, the three-way catalytic converter 26 comprises a first zone 26.1 and a second zone 26.2. Exhaust gas 28 flows through both zones. The first, forward zone 26.1 extends in the flow direction across a forward region of the three-way catalytic converter 26. The second, rear zone 26.2 extends downstream of the first zone 26.1 across a rear region of the three-way catalytic converter 26. Of course, further zones can be disposed upstream of the forward zone 26.1 and downstream of the rear zone 26.2 and between the two zones, for which the respective fill level may also be modelled.

Upstream of the three-way catalytic converter 26, a forward exhaust gas probe 32 that is exposed to the exhaust gas 28 is disposed immediately upstream of the three-way catalytic converter 26. Downstream of the three-way catalytic converter 26, a rear exhaust gas probe 34 that is exposed to the exhaust gas 28 is likewise disposed immediately downstream of the three-way catalytic converter 26. The forward exhaust gas probe 32 is preferably a wideband lambda probe that enables the measurement of the air ratio $\lambda$ over a wide range of air ratios. The rear exhaust gas probe 34 is preferably a so-called step-type lambda probe, with which the air ratio $\lambda=1$ can be measured particularly accurately, since the signal of the exhaust gas probe 34 changes abruptly there. Cf. Kraftfahrtechnisches Taschenbuch (Automotive Pocketbook), 23rd Edition, Page 524.

In the represented exemplary embodiment, a temperature sensor 36 that is exposed to the exhaust gas 28 and that detects the temperature of the three-way catalytic converter 26 is disposed in thermal contact with the exhaust gas 28 at the three-way catalytic converter 26.

Figure 2:
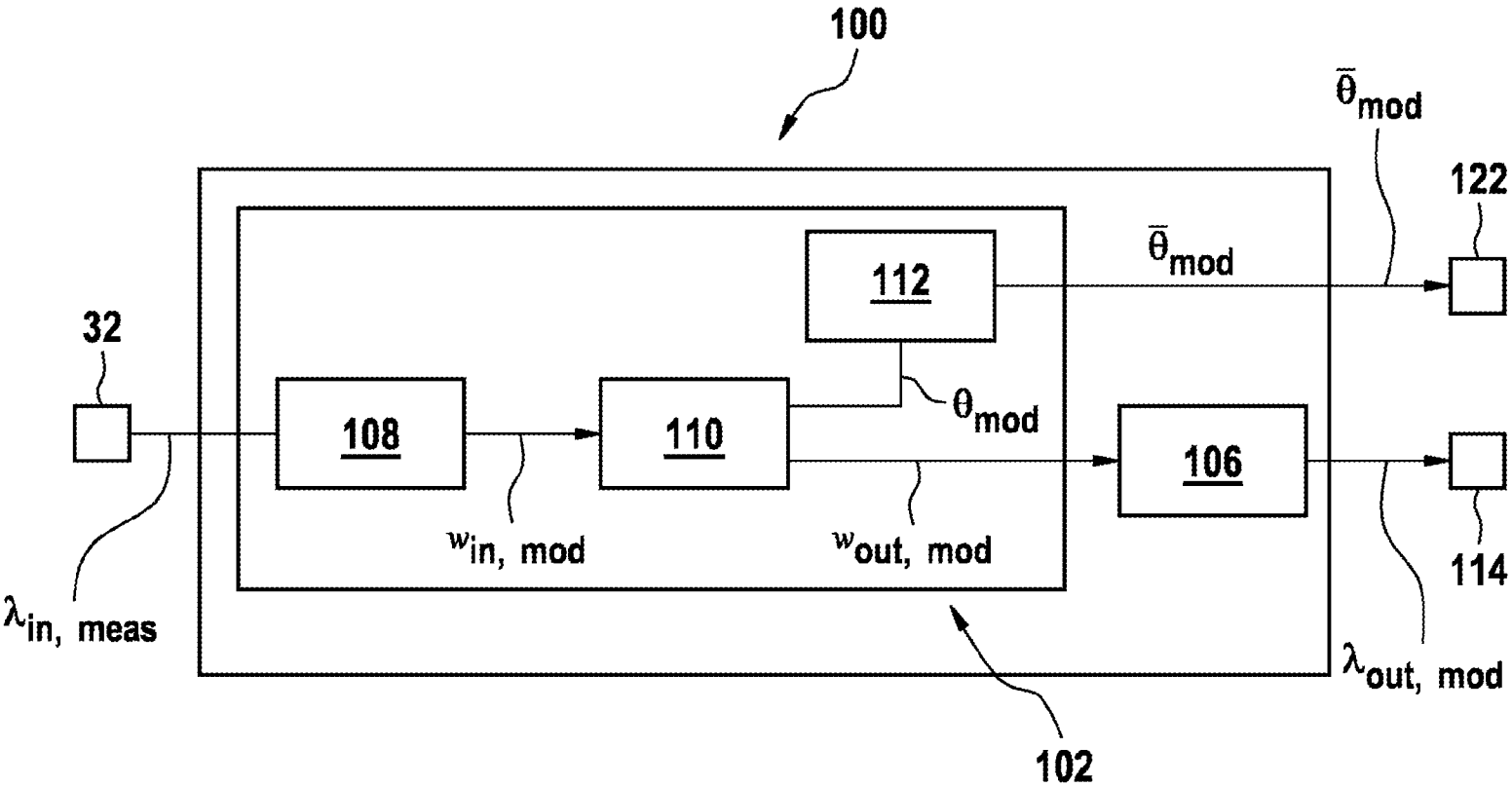
FIG. 2 shows a functional block diagram of a system model.

The control unit 16 processes the signals of the air flow sensor 18, the rotation angle sensor 25, the forward exhaust gas probe 32, the rear exhaust gas probe 34 and the temperature sensor 36 and forms therefrom actuation signals for adjustment of the angular position of the choke flap, for triggering ignitions by the ignition device 24 and for injecting fuel through the injection valves 22. Alternatively or in addition, the control unit 16 also processes signals of other or further sensors for actuating the represented actuators or even further or other actuators, for example the signal of a driver's demand sensor 40 that detects a gas pedal position. An overrun mode with switch-off of the fuel delivery is triggered by releasing the gas pedal, for example. This and the functions that are yet to be described below are carried out by an engine control program 16.1 running in the control unit 16 during operation of the combustion engine 10. In this application, a system model 100, a catalytic converter model 102, an inverse catalytic converter model 104 (cf. FIG. 3) and an output lambda model 106 are used. FIG. 2 shows a functional block diagram of a system model 100. The system model 100 consists of the catalytic converter model 102 and the output lambda model 106. The catalytic converter model 102 comprises an input emissions model 108 and a fill level and output emissions model 110. Moreover, the catalytic converter model 102 comprises an algorithm 112 for calculating an average fill level $\overline{\theta}_{mod}$ of the catalytic converter 26. The models are each algorithms that are executed in the control unit 16 and that combine input variables, which also act on the real object that is simulated with the computer model, with output variables so that the calculated output variables correspond to the output variables of the real object very accurately.

The input emissions model 108 is designed to convert the signal $\lambda_{in,meas}$ of the exhaust gas probe 32 disposed upstream of the three-way catalytic converter 26 as the input variable into the input variable $w_{in,mod}$ required for the subsequent level model 110. For example, a conversion of lambda in the concentrations of $O_2$, CO, $H_2$ and HC upstream of the three-way catalytic converter 26 using the input emissions model 108 is advantageous.

With the variable $w_{in,mod}$ calculated by the input emissions model 108 and possibly additional input variables (for example exhaust gas or catalytic converter temperatures, exhaust gas mass flow and the current maximum oxygen storage capacity of the three-way catalytic converter 26) a fill level $\theta_{mod}$ of the three-way catalytic converter 26 and concentrations $w_{out,mod}$ of the individual exhaust gas components at the output of the three-way catalytic converter 26 are modelled in the fill level and output emissions model 110.

In order to be able to portray filling and emptying processes more realistically, the three-way catalytic converter 26 is preferably divided conceptually by the algorithm into a plurality of zones or sub volumes 26.1, 26.2 disposed successively in the flow direction of the exhaust gases 28, and the concentrations of the individual exhaust gas components are determined using the reaction kinetics for each of the zones 26.1, 26.2. The concentrations can in turn each be converted to a fill level for the individual zones 26.1, 26.2, preferably to an oxygen fill level normalized to the current maximum oxygen storage capacity.

The fill levels of individual or all zones 26.1, 26.2 can be combined by means of a suitable weighting to a total fill level that reflects the state of the three-way catalytic converter 26. For example, the fill levels of all zones 26.1, 26.2 can in the simplest case all be equally weighted and thereby an average fill level can be determined. However, with a suitable weighting it can also be taken into account that the fill level in a comparatively small zone 26.2 at the output of the three-way catalytic converter 26 is decisive for the current exhaust gas composition downstream of the three-way catalytic converter 26, whereas the fill level in the upstream zone 26.1 and the development thereof are decisive for the development of the fill level in said small zone 26.2 at the output of the three-way catalytic converter 26. For the sake of simplicity, an average oxygen fill level is assumed below.

The algorithm of the output lambda model 106 converts the concentrations $w_{out,mod}$ of the individual exhaust gas components at the output of the catalytic converter 26 that are calculated with the catalytic converter model 102 for adaptation of the system model 100 to a signal $\lambda_{out,mod}$, which can be compared with the signal $\lambda_{out,meas}$ of the exhaust gas probe 34 that is disposed downstream of the catalytic converter 26. The lambda downstream of the three-way catalytic converter 26 is preferably modelled.

The system model 100 is thereby used on the one hand for modelling at least an average fill level $\overline{\theta}_{mod}$ of the catalytic converter 26, which is controlled to a fill level setpoint at which the catalytic converter 26 is safely within the catalytic converter window. On the other hand, the system model 100 provides a modelled signal $\lambda_{out,mod}$ of the exhaust gas probe 34 that is disposed downstream of the catalytic converter 26. It is described further below how the modelled signal $\lambda_{out,mod}$ of the rear exhaust gas probe 34 is advantageously used for adaptation of the system model 100.

Figure 3:
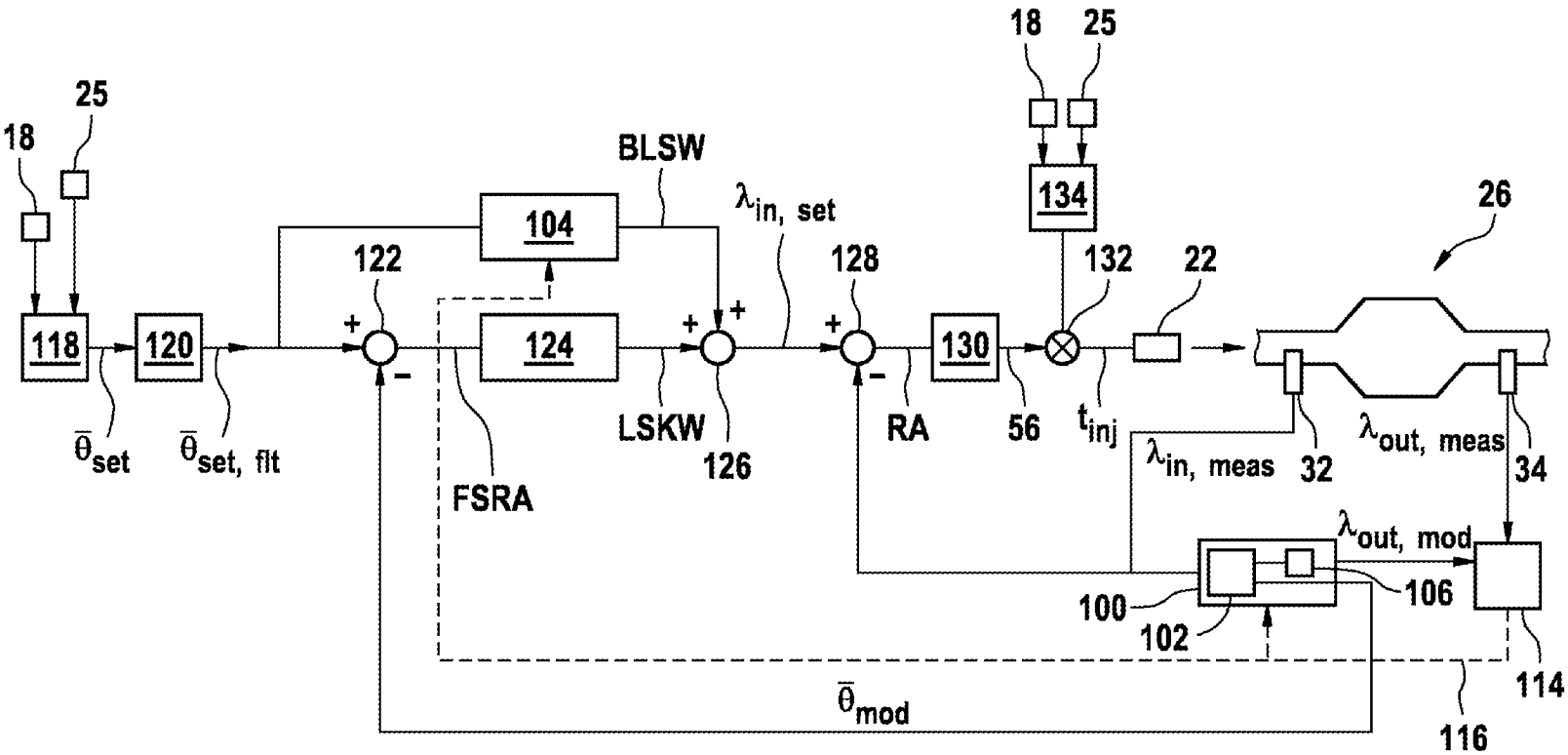
FIG. 3 shows a functional block diagram of an exemplary embodiment of a method according to the invention.

FIG. 3 shows a functional block diagram of an exemplary embodiment of a method according to the invention together with device elements that act on the function blocks or that are influenced by the function blocks.

FIG. 3 shows in detail how the signal $\lambda_{out,mod}$ of the rear exhaust gas probe 34 that is modelled by the output lambda model 106 is compared with the real output signal $\lambda_{out,meas}$ of the rear exhaust gas probe 34. For this purpose, the two signals $\lambda_{out,mod}$ and $\lambda_{out,meas}$ are delivered to an adaptation block 114. The adaptation block 114 compares the two signals $\lambda_{out,mod}$ and $\lambda_{out,meas}$ with each other. For example, a step-type lambda probe that is disposed as an exhaust gas probe 34 downstream of the three-way catalytic converter 26 unambiguously indicates when the three-way catalytic converter 26 is completely filled with oxygen or completely emptied of oxygen. This can be used following lean or rich phases to bring the modelled oxygen fill level into agreement with the actual oxygen fill level, or to bring the modelled output lambda into agreement with the lambda $\lambda_{out,meas}$ that is measured downstream of the three-way catalytic converter 26, and to adapt the system model 100 in the event of differences. The adaptation is carried out for example by the adaptation block 114 successively varying parameters of the algorithm of the system model 100 over the adaptation system 116 that is shown dashed until the lambda value $\lambda_{out,mod}$ that is modelled for the exhaust gas flowing out of the three-way catalytic converter 26 corresponds to the lambda value $\lambda_{out,meas}$ that is measured there.

As a result, inaccuracies of measurement variables or model variables that enter the system model 100 are compensated. From the circumstance that the modelled value $\lambda_{out,mod}$ corresponds to the measured lambda value $\lambda_{out,meas}$ it can be concluded that the fill level $\overline{\theta}_{mod}$ modelled with the system model 100 or with the first catalytic converter model 102 also corresponds to the fill level of the three-way catalytic converter 26 that cannot be measured with on-board means. It can then further be concluded that the second catalytic converter model 104 that is inverse to the first catalytic converter model 102, and which results from mathematical conversions from the algorithm of the first catalytic converter model 102, also correctly describes the behavior of the modelled system.

This is used in the present invention to calculate a base lambda setpoint value with the inverse second catalytic converter model 104. For this purpose, a fill level setpoint value $\overline{\theta}_{set,flt}$ filtered by optional filtering 120 is delivered as an input variable to the inverse second catalytic converter model 104.

The filtering 120 is carried out for the purpose of only permitting such changes of the input variable of the inverse second catalytic converter model 104 that the control loop can follow as a whole. A still unfiltered setpoint value $\overline{\theta}_{set}$ is in this case read from a memory 118 of the control unit 16. For this purpose, the memory 118 is preferably addressed with current operational parameters of the combustion engine 10. The operational parameters are for example, but not necessarily, the revolution rate that is detected by the revolution rate sensor 25 and the load on the combustion engine 10 that is detected by the air flow sensor 18.

The filtered fill level setpoint value $\overline{\theta}_{set,flt}$ is processed to a base lambda setpoint value BLSW with the inverse second catalytic converter model 104. In parallel with the processing, in an operation 122 a fill level control error FSRA is formed as the difference of the fill level $\overline{\theta}_{mod}$ modelled with the system model 100 or modelled with the first catalytic converter model 102 from the filtered fill level setpoint value $\overline{\theta}_{set,flt}$. the fill level control error FSRA is delivered to a fill level control algorithm 124, which forms therefrom a lambda setpoint value correction value LSKW. The lambda setpoint value correction value LSKW is added in the operation 126 to the base lambda setpoint value BLSW that is calculated by the inverse system model 104.

In a preferred design, the sum formed in this way is used as the setpoint value $\lambda_{in,set}$ of a conventional lambda controller. The actual lambda value $\lambda_{in,set}$ provided by the first exhaust gas probe 32 is subtracted from the lambda setpoint value $\lambda_{in,set}$ an operation 128. The control error RA formed in this way is converted by a usual control algorithm 130 into a control variable SG, which in an operation 132 is operated on for example by multiplication with a base value BW of an injection pulse width $t_{inj}$ that is specified depending on operating parameters of the combustion engine 10. The base values BW are stored in a memory 134 of the control unit 16. Here too, the operating parameters are preferably, but not necessarily, the load on and the revolution rate of the combustion engine 10. Fuel is injected into the combustion chambers 20 of the combustion engine 10 via the injection valves 22 with the injection pulse width $t_{inj}$ resulting from the product.

In this way the conventional lambda control is superimposed on the control of the oxygen fill level of the catalytic converter 26. In this case the average oxygen fill level $\overline{\theta}_{mod}$ that is modelled using the system model 100 or with the first catalytic converter model 102 is for example controlled to a setpoint value $\overline{\theta}_{set,flt}$, which minimizes the probability of breakthroughs following lean and rich phases and thus results in minimal emissions. As the base lambda setpoint value BLSW is formed by the inverted second system model 104 in this case, the control error of the fill level control means is zero if the modelled average fill level $\overline{\theta}_{mod}$ is identical to the prefiltered fill level setpoint $\overline{\theta}_{set,flt}$. The fill level control algorithm 124 only engages if this is not the case. Because the formation of the base lambda setpoint value acting as it were as the pilot control of the fill level control means is implemented as an inverted second catalytic converter model 104 of the first catalytic converter model 102, said pilot control can be adapted similarly to the adaptation of the first catalytic converter model 102 based on the signal $\lambda_{in,meas}$ of the second exhaust gas probe 34 that is disposed downstream of the three-way catalytic converter 26. This is illustrated in FIG. 3 by the branch of the adaptation system 116 leading to the inverted system model 104.

With the exception of the exhaust system 26, the exhaust gas probes 32, 34, the air flow sensor 18, the rotation angle sensor 25 and the injection valves 22, all the elements represented in FIG. 3 are elements of a control unit 16 according to the invention. With the exception of the memories 118, 134, in this case all other elements of FIG. 3 are parts of the engine control program 16.1, which is stored in the control unit 16 and runs therein.

The elements 22, 32, 128, 130 and 132 form a first control circuit, in which a lambda control is carried out, in which the signal $\lambda_{in,meas}$ of the first exhaust gas probe 32 is processed as the actual lambda value. The lambda setpoint value $\lambda_{in,set}$ of the first control circuit is formed in a second control circuit that comprises the elements 22, 32, 100, 122, 124, 126, 128, 132.

The invention claimed is:

1. A method for controlling a filling level in an exhaust gas component accumulator of a catalytic converter (26) in the exhaust gas of a combustion engine (10) including an air delivery system (12), an exhaust gas system (14), an exhaust gas component accumulator of a catalytic converter (26)

disposed in the exhaust gas system (14) of the combustion engine (10), a first exhaust gas probe (32) protruding into the exhaust gas flow upstream of the catalytic converter (26); a second exhaust gas probe (34) disposed downstream of the catalytic converter (26); a control unit (16), the method comprising:

determining an actual fill level ($\overline{\theta}_{mod}$) of the exhaust gas component accumulator with a first catalytic converter model (102);

detecting a concentration of the exhaust gas components via a signal of an inlet lambda measured value ($\lambda_{in,meas}$) of the first exhaust gas probe (32);

forming a lambda setpoint value ($\lambda_{in,set}$);

converting a predetermined fill level setpoint ($\overline{\theta}_{set,flt}$) into a base lambda setpoint value by a second catalytic converter model (104) that is inverse to the first catalytic converter model (100);

determining a difference of the actual fill level ($\overline{\theta}_{mod}$) from the predetermined fill level setpoint ($\overline{\theta}_{set,flt}$);

processing a lambda setpoint value correction value via a fill level controller (124);

forming a correction value based on a sum of the base lambda setpoint value and the lambda setpoint value correction value; and adjusting an injection valve (22) to deliver fuel to at least one combustion chamber (20) of the combustion engine (10) according to the correction value.

2. The method as claimed in claim 1, wherein the exhaust gas component is oxygen, and wherein the method further includes:

performing a lambda control in a first control circuit (22, 32, 128, 130, 132) based on a lambda actual value according to the signal of the inlet lambda measured value ($\lambda_{in,meas}$) of the first exhaust gas probe (32);

forming the lambda setpoint value ($\lambda_{in,set}$) in a second control circuit (22, 32, 100, 122, 124, 126, 128, 132);

converting the predetermined fill level setpoint ($\overline{\theta}_{set,flt}$) by the second catalytic converter model (104) that is inverse to the first catalytic converter model (102) into the base lambda setpoint value of the lambda control; and forming, in parallel thereto, a fill level control error as the difference of the fill level ($\overline{\theta}_{mod}$) that is modelled with the first catalytic converter model (100) from the filtered fill level setpoint value ($\overline{\theta}_{set,flt}$);

wherein the fill level control error is delivered to a fill level control algorithm (124), which forms therefrom a lambda setpoint value correction value; and wherein said lambda setpoint value correction value is added to the base lambda setpoint value that is calculated by the inverse second catalytic converter model (104) and the sum calculated thereby forms the inlet lambda setpoint value ($\lambda_{in,set}$).

3. The method as claimed in claim 1, wherein providing the first catalytic converter model (102) that is a component of a system model (100) that includes an output lambda model (106).

4. The method as claimed in claim 3, further comprising:

converting, via the output lambda model (106), concentrations of the individual exhaust gas components calculated using the first catalytic converter model (102) into a signal and comparing the signal of a second exhaust gas probe (34).

5. The method as claimed in claim 4, further comprising:

comparing the signal calculated with the output lambda model (106) with the signal measured by the second exhaust gas probe (34).

6. The method as claimed in claim 5, further comprising:

successively varying parameters of the system model (100) until an output lambda modelled value ($\lambda_{out,mod}$) of the exhaust gas flowing out of the three-way catalytic converter (26) is corresponding to an output lambda measured value ($\lambda_{out,meas}$).

7. The method as claimed in any claim 1, wherein providing the first catalytic converter model (102) that includes an input emissions model (108) and a fill level and emissions model (110).

8. The method as claimed in claim 7, wherein providing the first catalytic converter model (102) that includes sub models, each of the sub models is associated with a sub volume of the catalytic converter (16).

9. The method as claimed in any claim 1, further comprising:

predetermining a fill level setpoint being between 10% and 50% of the maximum oxygen storage capacity of the catalytic converter (26).

10. The method as claimed in any claim 1, wherein further comprising:

predetermining a fill level setpoint being between 25% and 35% of the maximum oxygen storage capacity of the catalytic converter (26).

11. A combustion engine (10) comprising:

an air delivery system (12);

an exhaust gas system (14);

an exhaust gas component accumulator of a catalytic converter (26) disposed in the exhaust gas system (14) of the combustion engine (10);

a first exhaust gas probe (32) protruding into the exhaust gas flow upstream of the catalytic converter (26);

a second exhaust gas probe (34) disposed downstream of the catalytic converter (26); and a control unit (16) including an engine control program (16.1) having executable instructions stored a non-transitory memory to control a filling level of the exhaust gas component accumulator of the catalytic converter (26);

determine an actual fill level ($\overline{\theta}_{mod}$) of the exhaust gas component accumulator with a first catalytic converter model (102);

detect a concentration of the exhaust gas component via a signal of an inlet lambda measured value ($\lambda_{in,meas}$) of the first exhaust gas probe (32);

form a lambda setpoint value ($\lambda_{in,set}$);

convert a predetermined fill level setpoint ($\overline{\theta}_{set,flt}$) into a base lambda setpoint value by a second catalytic converter model (104) that is inverse to the first catalytic converter model (100);

determine a difference of the actual fill level ($\overline{\theta}_{mod}$) from the predetermined fill level setpoint ($\overline{\theta}_{set,flt}$);

process a lambda setpoint value correction value by a fill level controller (124);

form a correction value based on a sum of the base lambda setpoint value and the lambda setpoint value correction value; and adjust an injection valve (22) to inject fuel into at least one combustion chamber (20) of the combustion engine (10) according to the correction value.

12. The combustion engine (10) as claimed in claim 11, wherein the exhaust gas component is oxygen; and wherein the control unit further comprising executable instructions to perform a lambda control in a first control circuit (22, 32, 128, 130, 132) based on a lambda actual value according to the signal of the inlet lambda measured value ($\lambda_{in,meas}$) of the first exhaust gas probe (32);

form the lambda setpoint value ($\lambda_{in,set}$) in a second control circuit (22, 32, 100, 122, 124, 126, 128, 132);

convert the predetermined fill level setpoint ($\overline{\theta}_{set,flt}$) is converted by the second catalytic converter model (104) that is inverse to the first catalytic converter model (102) into the base lambda setpoint value of the lambda control;

form, in parallel thereto, a fill level control error as the difference of the fill level ($\overline{\theta}_{mod}$) that is modelled with the first catalytic converter model (100) from the filtered fill level setpoint value ($\overline{\theta}_{set,flt}$);

wherein said fill level control error is delivered to a fill level control algorithm (124), which forms therefrom a lambda setpoint value correction value; and wherein the lambda setpoint value correction value is added to the base lambda setpoint value that is calculated by the inverse second catalytic converter model (104) and the sum calculated thereby forms the inlet lambda setpoint value ($\lambda_{in,set}$).

13. The combustion engine (10) as claimed in claim 11, wherein the first catalytic converter model (102) is a component of a system model (100) that includes an output lambda model (106).

14. The combustion engine (10) as claimed in claim 13, wherein the output lambda model (106) is configured to convert concentrations of the individual exhaust gas components calculated using the first catalytic converter model (102) into a signal that is compared with the signal of a second exhaust gas probe (34).

15. The combustion engine (10) as claimed in claim 14, wherein the signal calculated with the output lambda model (106) is compared with the signal measured by the second exhaust gas probe (34).

16. The combustion engine (10) as claimed in claim 15, wherein parameters of the system model (100) are successively varied until an output lambda modelled value ($\lambda_{out,mod}$) that is modelled for the exhaust gas flowing out of the three-way catalytic converter (26) corresponds to an output lambda measured value ($\lambda_{out,meas}$).

17. The combustion engine (10) as claimed in claim 11, wherein the first catalytic converter model (102) includes an input emissions model (108) and a fill level and emissions model (110).

18. The combustion engine (10) as claimed in claim 17, wherein the first catalytic converter model (102) includes sub models, each of the sub models is associated with a sub volume of the catalytic converter (26).

* * * * *